United States Patent [19]

Holleck

[11] 4,432,794

[45] Feb. 21, 1984

[54] HARD ALLOY COMPRISING ONE OR MORE HARD PHASES AND A BINARY OR MULTICOMPONENT BINDER METAL ALLOY

[75] Inventor: Helmut Holleck, Karlsruhe, Fed. Rep. of Germany

[73] Assignee: Kernforschungszentrum Karlsruhe GmbH, Karlsruhe, Fed. Rep. of Germany

[21] Appl. No.: 286,376

[22] Filed: Jul. 17, 1981

[30] Foreign Application Priority Data

Jul. 19, 1980 [EP] European Pat. Off. ..... 80104274

[51] Int. Cl.[3] ..... B22F 3/16; C22C 14/00; C22C 27/00; C22C 28/00

[52] U.S. Cl. ..... 75/239; 75/236; 75/240; 419/17; 419/18; 419/45; 419/46; 419/54; 420/433; 420/462; 420/461; 420/463; 420/466

[58] Field of Search ..... 75/240, 239, 241, 203, 75/204, 236, 176; 419/17, 18, 54, 45, 46; 420/417, 430, 433, 462, 461, 463, 466

[56] References Cited

U.S. PATENT DOCUMENTS

| | | | |
|---|---|---|---|
| 3,379,520 | 4/1968 | Chang | 75/241 |
| 3,395,013 | 7/1968 | Friedman | 75/176 |
| 3,554,737 | 1/1971 | Foster | 75/176 |
| 3,628,921 | 12/1971 | Hill | 75/240 |
| 3,690,962 | 9/1972 | Rudy | 75/241 |
| 4,067,742 | 1/1978 | Fletcher | 75/239 |
| 4,097,275 | 6/1978 | Horvath | 75/203 |

FOREIGN PATENT DOCUMENTS 828877 2/1960 United Kingdom .

OTHER PUBLICATIONS

Warren et al., Powder Metallurgy International, vol. 7, 1975, pp. 18 to 20.

*Primary Examiner*—L. Dewayne Rutledge
*Assistant Examiner*—J. J. Zimmerman
*Attorney, Agent, or Firm*—Spencer, Kaye & Frank

[57] ABSTRACT

A hard alloy including at least one hard phase and a binary or multicomponent binder metal alloy, in which the hard substance comprises a finely dispersed, homogeneous distribution in the binder metal. The hard phase comprises a carbide of a Group IVb, Vb or VIb transition metal, and the binder metal alloy comprises a solid alloy of a Group IVb, Vb or VIb transition metal, with Re, Ru, Rh, Pd, Os, Ir, or Pt.

14 Claims, 1 Drawing Figure

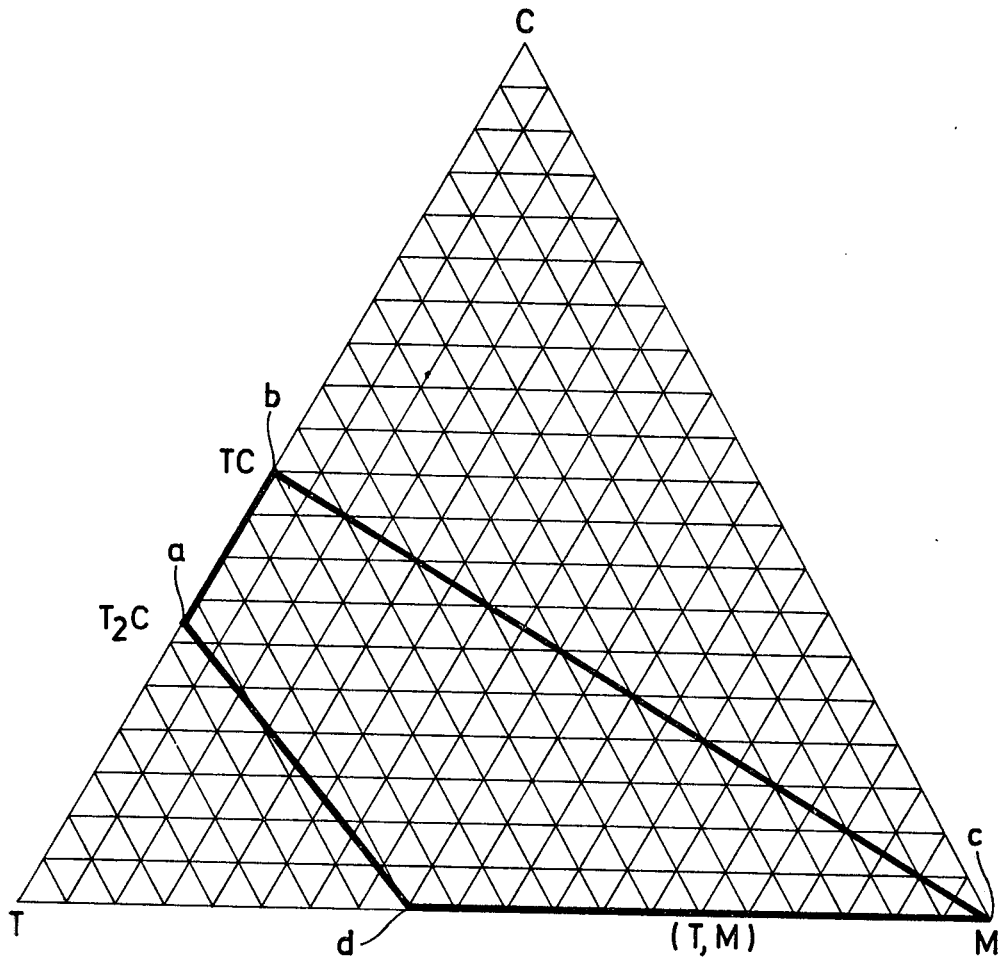
C
b
TC
a
$T_2C$
c
T
d
(T, M)
M

HARD ALLOY COMPRISING ONE OR MORE HARD PHASES AND A BINARY OR MULTICOMPONENT BINDER METAL ALLOY

BACKGROUND OF THE INVENTION

The present invention relates to a hard alloy comprising one or more hard phases and a binary or multicomponent binder metal alloy.

Hard metals or hard alloys have been described by R. Keiffer and F. Benesovsky, in "Hartmetalle," (1965), pages 216 to 223. Hard metals containing a basic carbide of chromium carbide ($Cr_3C_2$) and 12% or 15% nickel binder are discussed therein which exhibit good wear resistance and high corrosion resistance. However, such chromium carbide hard metals are relatively brittle, which must be taken into consideration where impact stresses are concerned. Also, with increasing nickel content, the corrosion resistance of $Cr_3C_2$ hard metals decreases. Moreover, use of $Cr_3C_2$ hard metals as high temperature working materials is precluded by its insufficient toughness and poor resistance to alternating temperature stresses. Experiments in which $Cr_3C_2$ has been partially replaced by $Mo_2C$, WC, TiC or TaC and in which nickel has been replaced by cobalt, copper, iron or molybdenum have not resulted in significant property improvements.

Another way to produce corrosion resistant hard metals is to replace the cobalt in WC-Co or WC-TiC-Co alloys, by corrosion resistant binder alloys. For this purpose, alloys of nickel and chromium in a ratio of 80:20 or 70:30 have been used. In practice, 6 to 20%, preferably 8 to 10% of such a binder alloy can be used in the hard metal.

A platinum bound WC hard metal has also been produced. This hard metal is recommended for construction of reactors subject to heavy neutron radiation. See Kieffer et al., p. 221.

Disadvantages of prior art hard alloys include their relatively low strength and/or their high specific weight.

SUMMARY OF THE INVENTION

It is an object of the present invention to produce a material which has high strength, great hardness, and great wear resistance, and which is essentially resistant to corrosive, and possibly oxidizing, media.

It is another object of the present invention to produce this material by a simple method.

To achieve these objects, and in accordance with its purpose, the present invention provides a hard alloy including at least one hard phase and a binary or multicomponent binder metal alloy, comprising a finely dispersed, homogeneous distribution of the at least one hard phase in the binder metal alloy, the at least one hard phase comprising a carbide of a transition metal of Group IVb, Vb, or VIb of the Periodic Table of Elements, and the binder metal alloy comprising a solid alloy of a transition metal of Group IVb, Vb or VIb of the Periodic Table of Elements, with Re, Ru, Rh, Pd, Os, Ir, or Pt.

It is understood that both the foregoing general description and the following detailed description are exemplary, but are not restrictive of the invention.

BRIEF DESCRIPTION OF THE DRAWING

The sole drawing FIGURE is a ternary diagram showing the composition of hard alloys according to the present invention.

DETAILED DESCRIPTION OF THE INVENTION

The hard materials of the present invention are formed of a fine dispersion of at least one hard phase in a binary or multicomponent binder metal alloy which serves as a metal matrix or phase. The hard substance comprises a carbide of a transition metal of Group IVb, Vb or VIb of the Periodic Table of Elements. The preferred hard substances are the carbides of Mo, Cr, and W.

The carbide component of the hard alloy generally has a composition which corresponds to an atom ratio of transition metal to carbon of 1:1 to 2:1.

The binary or multicomponent binder metal alloy is an alloy of a transition metal of Group IVb, Vb or VIb of the Periodic Table of Elements, with rhenium and/or a "platinum metal" from Group VIIIb of the [K. Rauscher et al.: "Chemische Tabellen und Rechentafeln für die analytische Praxis" (1968), pages 20 and 21]. Periodic Table of Elements. The platinum metals include Ru, Rh, Pd, Os, Ir and Pt.

Suitable metal phases for the binary binder metal alloy include alloys based on (Pt-Cr), (Pt-Mo), (Pt-W), (Pd-Cr), (Pd-Mo), (Pd-W), (Ru-Cr), (Ru-Mo), (Ru-W), or other platinum metals with Cr, Mo and W.

Preferably, the proportion of transition metal in the binder metal alloy is 2 to 60 mole percent.

In a further advantageous embodiment of the present invention, the proportion of Re or the platinum metal in the binder metal alloy is replaced from 0 to 90 atom percent by iron, cobalt or nickel. The binder metal alloy can be a multicomponent compound or a mixture of binary compounds.

According to a preferred embodiment of the present invention, the hard alloy contains a hard phase to binder metal alloy ratio between 90 volume percent hard phase to 10 volume percent binder metal alloy and 5 volume percent had phase to 95 volume percent binder metal alloy.

In a preferred method for producing the hard alloy of the present invention, the homogeneous distribution of the hard phase in the binder metal is achieved by forming an intermediate ternary or multicomponent carbide. This intermediate ternary or multicomponent carbide is decomposed in the manufacturing process to form the desired hard alloy.

In one such method, powder of a transition metal from Group IVb, Vb or VIb is mixed with a powder of the metal rhenium and/or of a platinum metal and with carbon powder in a stoichiometric ratio corresponding to a carbide having at least two metal components. This powder mixture is pressed to form at least one pressed body, and the pressed body (bodies) is (are) melted or sintered depending on the system to form a multicomponent carbide. The melting or sintering temperature will be 1450° K. or more, but in each individual case, will be a temperature above the lower decomposition temperature of the multicomponent high temperature carbide which is present. Firstly, the melted or sintered bodies are subjected to a decomposition or homogenization heat treatment and are cooled to room temperature. The melting or sintering step is done for obtaining the high temperature carbide whereas the low temperature (ca. 1300° K.) heat treatment (times about 1–24 hours) gives the fine decomposition microstructures by the decomposition of the carbide (which is only stable at high temperatures) into binary carbides and binary or multicomponent metal alloys, stable at low temperatures.

The melting temperatures are considerably higher than the decomposition temperatures. The sintering temperature must only be slightly higher than the decomposition temperature.

In one embodiment of this method according to the present invention, chromium powder is mixed with a powder of at least one of the metals of the group Ru, Rh, Ir and Pt and with carbon powder in a ratio corresponding to one of the formulas (a) $(Cr_{0.5}Ru_{0.5})C_{0.33}$,
(b) $(Cr_{0.5}Rh_{0.5})C_{0.25}$,
(c) $(Cr_{0.5}Ir_{0.5})C_{0.25}$,
(d) $(Cr_{0.5}Pt_{0.5})C_{0.1}$ or
(e) a mixture of at least two of the formulas (a) to (d).

The mixture, as represented by one of the formulas (a) to (e), after pressing, is melted to form an intermediate (high temperature) carbide or is sintered at temperatures above the decomposition temperatures of the multicomponent carbides present.

In another embodiment of the method according to the invention, molybdenum powder is mixed with a powder of at least one of the metals of the group Re, Ru, Rh, Os, Ir, Pt and with carbon powder in a ratio corresponding to one of the formulas (a) $(Mo_{0.5}Re_{0.5})C_{0.4}$,
(b) $(Mo_{0.5}Ru_{0.5})C_{0.33}$,
(c) $(Mo_{0.5}Rh_{0.5})C_{0.25}$,
(d) $(Mo_{0.5}Os_{0.5})C_{0.33}$,
(e) $(Mo_{0.5}Ir_{0.5})C_{0.25}$,
(f) $Mo_{0.5}Pt_{0.5}(C_{0.1}$ or
(g) a mixture of at least two of formulas (a) to (f).

The mixture, as represented by one of the formulas (a) to (g), after pressing, is melted to form an intermediate carbide or sintered at temperatures above the decomposition temperatures of the multicomponent carbides present.

In a further embodiment of the method according to the invention, tungsten powder is mixed with a powder of at least one of the metals of the group Ru, Rh, Os and Pt and with carbon powder in a ratio corresponding to one of the formulas (a) $(W_{0.5}Ru_{0.5})C_{0.33}$,
(b) $(W_{0.5}Rh_{0.5})C_{0.25}$,
(c) $(W_{0.5}Os_{0.5})C_{0.33}$,
(d) $(W_{0.5}Pt_{0.5})C_{0.1}$ or
(e) a mixture of at least two of the formulas (a) to (d).

The mixture, as represented by one of formulas (a) to (e), after pressing, is melted to form an intermediate carbide or is sintered at temperature above the decomposition temperatures of the multicomponent carbides present.

In another embodiment for producing a hard alloy according to the invention, a powder of a prefabricated carbide of a transition metal from Group IVb, Vb or VIb is mixed with a powder of a transition metal from Group IVb, Vb or VIb, and the metal Re and/or of one of the platinum metals in a stoichiometric ratio which corresponds to a carbide having at least two metal components.

This powder mixture is pressed into pressed bodies, and the pressed bodies are melted or sintered at temperatures of 1450° K. or more, but in each individual case, at a temperature above the decomposition temperature of the multicomponent carbide present. Finally, the melted or sintered bodies are subjected to a decomposition (homogenization) heat treatment and are cooled.

In all cases, a decomposition heat treatment is effected after the melting or sintering process. In this way, alloys are produced which are distinguished by the finest distribution of carbides in a solid, tough and corrosion resistant binder metal matrix.

The present invention is distinguished in that ternary or multicomponent high temperature carbides are obtained which, during cooling or heat treatment at average temperatures, about 1273° K. to 1575° K., decompose into a carbide phase and a solid binder metal alloy phase. The heat treatment can be controlled in such a manner that extremely fine-grained structures result which have a uniform carbide distribution.

This can be done by choosing a low temperature prohibiting grain growth, but high enough to guarantee the decomposition reaction. The invidual temperatures (~1200°–1400° K.) depend on the system.

This produces hardness and strength and is the basis for favorable wear behavior. For example, a hard alloy containing 63 volume percent binary binder metal phase and 37 volume percent carbide ($Mo_2C$) has a hardness of 1060 HV and, determined according to the length of crack method, a very high toughness.

The hard alloys according to the present invention are substances with fine-grained microstructures having a total composition defined in quadrangle a-b-c-d of the FIGURE where T is a transition metal from Group IVb, Vb or VIb, M is Re or a platinum metal, and C is a carbon. The composition includes a carbide phase ($TC-T_2C$) and an alloy phase (T,M).

A significant feature of the invention is, moreover, the manufacturing method in which a ternary or multicomponent carbide is produced by a high temperature sintering or melting, and this ternary or multicomponent carbide is caused to decompose, at lower temperatures, into a binary carbide phase and a binary or multicomponent metal phase.

The following table shows compositions of such ternary carbide phases with transition metals from Group VI, whose decomposition is utilized according to the invention.

Ternary Cubic Face Centered Carbides of the Transition Metals Cr, Mo and W with Rhenium and Platinum Metals

| Carbide | Lattice Constant (nm) | Existence Region Remarks |
|---|---|---|
| $(Cr_{0.5}Ru_{0.5})C_{\sim 0.33}$ | a = 0.386 | homogeneous region; stable at 1575° K. ≦ T ≦ 1730° K. |
| $(Cr_{0.5}Rh_{0.5})C_{\sim 0.25}$ | a = 0.379 | homogeneous region; stable at T > ~ 1450° K. |
| $(Cr_{0.5}Ir_{0.5})C_{\sim 0.25}$ | a = 0.379 | homogeneous region; T = 1773° K. |
| $Cr_{0.5}Pt_{0.5})C_{\sim 0.1}$ | a = 0.383 | homogeneous region; T = 1773° K. |
| $(Mo_{0.5}Re_{0.5})C_{\sim 0.4}$ | a = 0.409 | homogeneous region; T = 1773° K. |
| $(Mo_{0.5}Ru_{0.5})C_{\sim 0.33}$ | a = 0.402 | homogeneous region; T > ~ 1575° K. |
| $(Mo_{0.5}Rh_{0.5})C_{\sim 0.25}$ | a = 0.397 | homogeneous region; T > ~ 1630° K. |
| $(Mo_{0.5}Os_{0.5})C_{\sim 0.33}$ | a = 0.405 | homogeneous region in melt samples; T > 1800° K. |
| $(Mo_{0.5}Ir_{0.5})C_{\sim 0.25}$ | a = 0.398 | homogeneous region in melt samples; T > 1800° K. |
| $(Mo_{0.5}Pt_{0.5})C_{\sim 0.1}$ | a = 0.396 | homogeneous region; |

-continued

Ternary Cubic Face Centered Carbides of the Transition Metals Cr, Mo and W with Rhenium and Platinum Metals

| Carbide | Lattice Constant (nm) | Existence Region Remarks |
|---|---|---|
| | | T > 1500° K. |
| $(W_{0.5}Ru_{0.5})C_{\sim 0.33}$ | a = 0.400 | homogeneous region; T = 2270° K. |
| $(W_{0.5}Rh_{0.5})C_{\sim 0.25}$ | a = 0.395 | homogeneous region; T = 2270° K. |
| $(W_{0.5}Os_{0.5})C_{\sim 0.33}$ | a = 0.401 | homogeneous region; T > 2300° K. |
| $(W_{0.5}Pt_{0.5})C_{\sim 0.1}$ | a = 0.399 | homogeneous region; T = 2270° K. |

(homogeneous region = the carbide phase exists for various metal ratios, depending on the temperature).

However, hard alloys according to the invention in the region defined in the FIGURE can also be produced from other transition metals of Group IVb, Vb and VIb and Re and/or a platinum metal.

Wear and corrosion resistant hard metal alloys of these types can be used in tools and parts subject to wear which are used under particularly corrosive (and sometimes oxidation prone) environments. There are also favorable areas of use in the nuclear field for the hard alloys of the present invention due to the short-lived isotopes which occur with neutron radiation of some platinum metals, e.g., Pt, in contradistinction to the conventional binder metal Co.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

A material based on a molybdenum carbide-(Mo, Pt) alloy was obtained by melting or sintering, at a temperature above 1575° K., a mixture of Mo/Pt/C in a ratio of 50/35/15 atom percent, respectively. Such a sample lies at the end of the ternary carbide (Mo, Pt) $C_{\sim 1.0}$ in the isothermal diagram of the system Mo-Pt-C at 1773° K. The mixture of Mo/Pt/C which was subjected to melting or sintering at 1800° K. was in the form of pressed bodies. A subsequent heat treatment of some hours at 1373° K. led to the decomposition according to the phase relationship in the diagram at 1373° K. into $Mo_2C$ an $\eta$- (Mo, Pt). The resulting hard alloy was then cooled. The contents of the binary metallic phase or of the carbide phase can be varied as required. WC-(W, Ir) or WC-(W, Pt) alloys having very high metal contents have also been produced.

EXAMPLE 2

A W/Pt/C sample including 50 atom percent W, 40 atom percent Pt and 10 atom percent C achieved by the starting material WC, W and Pt in the stoichiometric ratios is melted or sintered at 2273° K., and cooled rapidly to room temperature. Subsequently the sample was homogenized for 24 hours at a temperature of 1373° K., and then cooled again to RT. Finest WC and $W_2C$ particles are thereby dissolved in a (W, Pt) matrix.

EXAMPLE 3

A W/Rh/C sample including 40 atom percent W, 40 atom percent Rh and 20 atom percent C achieved by the starting material WC, W and Rh in the stoichiometric ratios is melted or sintered at 2273° K., and cooled rapidly to room temperature. Subsequently the sample was homogenized for 24 hours at 1773° K., and then cooled again to RT. The microstructure shows WC and $W_2C$ particles of about 1 to 2 microns homogeneously distributed in a (W, Rh) alloy.

It will be understood that the above description of the present invention is susceptible to various modifications, changes and adaptions, and the same are intended to be comprehended within the meaning and range of equivalents of the appended claims.

What is claimed is:

1. A hard alloy comprising at least one hard phase and a binary or multicomponent binder metal alloy, said hard alloy comprising a finely dispersed, homogeneous distribution of said at least one hard phase in said binder metal alloy, said at least one hard phase comprising a carbide of a transition metal of Group IVb, Vb or VIb of the Periodic Table of Elements, and said binder metal alloy comprising a solid alloy of a transition metal of Group IVb, Vb or VIb of the Periodic Table of Elements, with Ru, Rh, Pd, Os, Ir or Pt, with the proportion of transition metal in said binder metal alloy comprising 2 to 60 mole percent, and the remaining 98 to 40 mole percent of said binder metal alloy comprising (a), Ru, Rh, Pd, Os, Ir or Pt, and (b) 0 to 90 atom percent Fe, Ni or Co, the atom percent of Fe, Ni or Co being based on the total atom percent of Ru, Rh, Pd, Os, Ir, Pt, Fe, Ni and Co percent.

2. Hard alloy according to claim 1, wherein the ratio of hard phase to binder metal alloy is in a range between 90 volume percent hard substance to 10 volume percent binder metal alloy, and 5 volume percent hard substance to 95 volume percent binder metal alloy.

3. Hard alloy according to claim 1 or 2, wherein said carbide has a composition which corresponds to a transition metal to carbon atom ratio in a range from 1:1 to 2:1.

4. Method for producing a hard alloy according to claim 1, comprising:

(a) forming a powder mixture of (i) a powdered transition metal of Group IVb, Vb and VIb, (ii) a powder of Ru, Rh, Pd, Os, Ir or Pt, and (iii) carbon powder, in stoichiometric proportions which correspond to a high temperature carbide having at least two metal components;

(b) pressing the powder mixture to form pressed bodies;

(c) heat treating the pressed bodies at a temperature which is at least 1450° K., and which is above the decomposition temperature of said high-temperature carbide having at least two metal components to form said high temperature carbide;

(d) subjecting the heat treated bodies of step (c) to a decomposition heat treatment, and then cooling.

5. Method according to claim 4, wherein said powder mixture is formed from Cr powder, C powder, and at least one of the powders of Ru, Rh, Ir or Pt, in a ratio which corresponds to one of the formulas (a) $(Cr_{0.5}Ru_{0.5})C_{0.33}$, (b) $(Cr_{0.5}Rh_{0.5})C_{0.25}$, (c) $(Cr_{0.5}Ir_{0.5})C_{0.25}$, (d) $(Cr_{0.5}Pt_{0.5})C_{0.1}$, or (e) a mixture of at least two of the formulas (a) to (d).

6. Method according to claim 4, wherein said powder mixture is formed from Mo powder, C powder, and at least one powder of the metals Ru, Rh, Os, Ir and Pt, in a ratio which corresponds to one of the formulas (a) $(Mo_{0.5}Ru_{0.5})C_{0.33}$,
(b) $(Mo_{0.5}Rh_{0.5})C_{0.25}$,
(c) $(Mo_{0.5}Os_{0.5})C_{0.33}$,
(d) $(Mo_{0.5}Ir_{0.5})C_{0.25}$,
(e) $(Mo_{0.5}Pt_{0.5})C_{0.1}$ or
(f) a mixture of at least two of the formulas (a) to (e).

7. Method according to claim 4, wherein said powder mixture is formed from W powder, C powder, and at least one of the metals Ru, Rh, Os and Pt, in a ratio which corresponds to one of the formulas (a) $(W_{0.5}Ru_{0.5})C_{0.33}$,
(b) $(W_{0.5}Rh_{0.5})C_{0.25}$,
(c) $(W_{0.5}Os_{0.5})C_{0.33}$,
(d) $(W_{0.5}Pt_{0.5})C_{0.1}$ or
(e) a mixture of at least two of the formulas (a) to (d).

8. Method for producing a hard alloy according to claim 1, comprising:

(a) forming a powder mixture of a prefabricated powdered carbide of a transition metal of Group IVb, Vb and VIb, a powder of transition metal of Group IVb, Vb and VIb, and Ru, Rh, Pd, Os, Ir or Pt in stoichiometric proportions which correspond to a carbide having at least two metal components;
(b) pressing the powder mixture to form pressed bodies;
(c) heat treating the pressed bodies at a temperature which is at least 1450° K., and which is above the decomposition temperature of said high-temperature carbide having at least two metal components, to form said high temperature carbide;
(d) subjecting the heat-treated bodies of step (c) to a decomposition heat treatment, and then cooling.

9. Hard alloy according to claim 1, wherein said binder metal alloy comprises a solid alloy of a transition metal of Group IVb, Vb or VIb of the Periodic Table of Elements, with Ru, Rh, Pd, Os or Ir.

10. Method according to claim 4, wherein said binder metal alloy comprises a solid alloy of a transition metal of Group IVb, Vb or VIb of the Periodic Table of Elements, with Ru, Rh, Pd, Os or Ir.

11. Method according to claim 8, wherein said binder metal alloy comprises a solid alloy of a transition metal of Group IVb, Vb or VIb of the Periodic Table of Elements, with Ru, Rh, Pd, Os or Ir.

12. Hard alloy according to claim 1, wherein said binder metal alloy comprises a solid alloy of a transition metal of Group IVb, Vb or VIb of the Periodic Table of Elements, with Rh, Pd, Os or Ir.

13. Hard alloy according to claim 4, wherein said binder metal alloy comprises a solid alloy of a transition metal of Group IVb, Vb or VIb of the Periodic Table of Elements, with Rh, Pd, Os or Ir.

14. Hard alloy according to claim 8, wherein said binder metal alloy comprises a solid alloy of a transition metal of Group IVb, Vb or VIb of the Periodic Table of Elements, with Rh, Pd, Os or Ir.

* * * * *